US008196502B2

(12) United States Patent
von Freden

(10) Patent No.: US 8,196,502 B2
(45) Date of Patent: Jun. 12, 2012

(54) DEVICE FOR THE ROTATIVE SCORING OF FLAT PRINTED PRODUCTS

(75) Inventor: Christoph von Freden, Schwaforden (DE)

(73) Assignee: Kolbus GmbH & Co. KG, Rahden (DE)

( * ) Notice: Subject to any disclaimer, the term of this patent is extended or adjusted under 35 U.S.C. 154(b) by 585 days.

(21) Appl. No.: 12/287,611

(22) Filed: Oct. 10, 2008

(65) Prior Publication Data

US 2009/0100978 A1 Apr. 23, 2009

(30) Foreign Application Priority Data

Oct. 17, 2007 (DE) ..... 10 2007 049 636

(51) Int. Cl.
*B31B 1/25* (2006.01)

(52) U.S. Cl. ..... 83/885; 83/881; 83/114

(58) Field of Classification Search ..... 83/883, 83/884, 885, 886, 887, 879, 436.1, 436.15, 83/114, 115, 284, 373, 881; 412/16, 22
See application file for complete search history.

(56) References Cited

U.S. PATENT DOCUMENTS 212,315 A * 2/1879 Lodge ..... 83/886
223,475 A * 1/1880 Brombacher ..... 83/886
244,845 A * 7/1881 Bowles ..... 83/117
271,848 A * 2/1883 Holton ..... 12/52.5
1,196,912 A * 9/1916 Weck ..... 493/396
1,781,900 A * 11/1930 Friede ..... 83/115
1,873,792 A * 8/1932 Sheeler ..... 83/303
1,982,880 A * 12/1934 Pachter ..... 83/269
2,006,107 A * 6/1935 Markert ..... 83/114
2,242,514 A * 5/1941 De Smith ..... 83/886
2,535,195 A * 12/1950 Colucci, Jr. et al. ..... 144/24.11
2,665,435 A * 1/1954 Hildmann ..... 412/13
2,671,912 A * 3/1954 Stein et al. ..... 412/16
2,781,095 A * 2/1957 Spinner ..... 493/363
2,837,978 A * 6/1958 Anderson ..... 493/365
3,274,874 A * 9/1966 Treiber et al. ..... 83/348
3,509,788 A * 5/1970 Glendening ..... 83/114
3,570,335 A * 3/1971 Marin ..... 83/864

(Continued)

*Primary Examiner* — Sean Michalski
(74) *Attorney, Agent, or Firm* — Alix, Yale & Ristas, LLP

(57) ABSTRACT

The invention pertains to a device (1) for the rotative scoring of flat printed products in order to prepare a bending line, particularly in a brochure cover that is supplied in the form of a sheet (2), with said device featuring at least one pair of scoring tools (11.1, 11.2) that consists of a scoring knife (12) and an assigned scoring matrix (13), with the scoring tools (12, 13) being arranged on a first and a second scoring shaft (14.1, 14.2) that are arranged parallel to one another and driven in opposite directions, and with said device also featuring at least one pair of transport rollers (30) that is arranged axially adjacent to the pair of scoring tools (11.1, 11.2) and consists of a first and a second transport roller (31, 32) that effectively clamp the sheet (2) between one another with respect to its transport, wherein it is proposed that the first transport roller (31) is arranged on the first scoring shaft (14.1) and the second transport roller (32) is supported independently of the scoring tools (12, 13). The axial spacing of the at least one pair of scoring tools (11.1, 11.2) can be adjusted in accordance with the desired scoring depth without affecting the at least one pair of transport rollers (30). The load on the scoring shafts (14.1, 14.2) is significantly reduced because bending due to an excessively narrow adjustment of the transport rollers (31, 32) is prevented.

8 Claims, 3 Drawing Sheets

U.S. PATENT DOCUMENTS 3,646,418 A * 2/1972 Sterns et al. ..... 318/603
3,797,362 A * 3/1974 Heckman ..... 409/163
3,855,890 A * 12/1974 Lynch et al. ..... 83/331
4,137,803 A * 2/1979 Goldinger ..... 83/881
4,205,596 A * 6/1980 Chesnut ..... 493/370
4,217,693 A * 8/1980 Roder et al. ..... 30/292
4,220,272 A * 9/1980 Danti ..... 225/2
4,230,281 A * 10/1980 Hill et al. ..... 241/142
4,601,693 A * 7/1986 Richey ..... 493/370
4,624,161 A * 11/1986 Namowicz et al. ..... 83/47
4,694,722 A * 9/1987 Collier et al. ..... 83/885
4,856,400 A * 8/1989 Kelzer ..... 83/885
5,445,054 A * 8/1995 Pryor ..... 83/37
5,601,007 A * 2/1997 Clough et al. ..... 83/887
6,099,225 A * 8/2000 Allen et al. ..... 412/32
7,028,598 B2 * 4/2006 Teshima ..... 83/879
7,359,764 B2 * 4/2008 Bonaddio et al. ..... 700/193
2002/0192415 A1 * 12/2002 Vogler et al. ..... 428/40.1
2009/0100978 A1 * 4/2009 von Freden ..... 83/883

* cited by examiner

Fig. 5
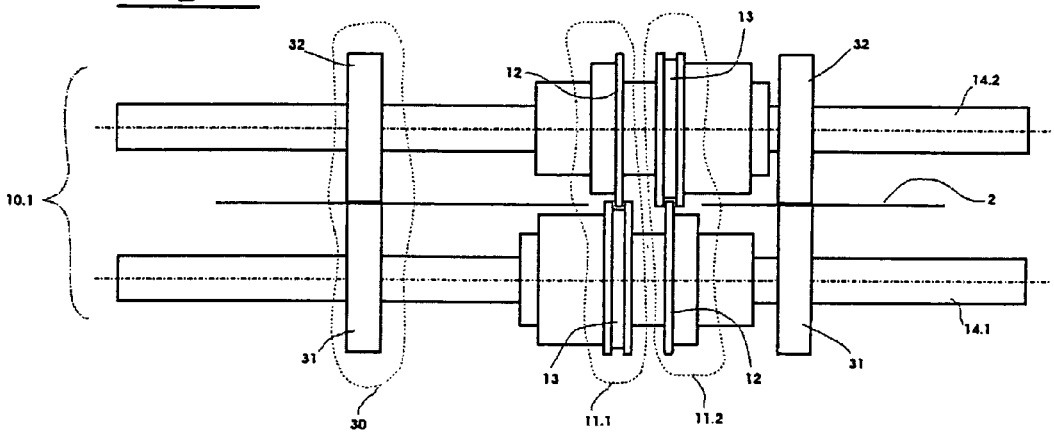
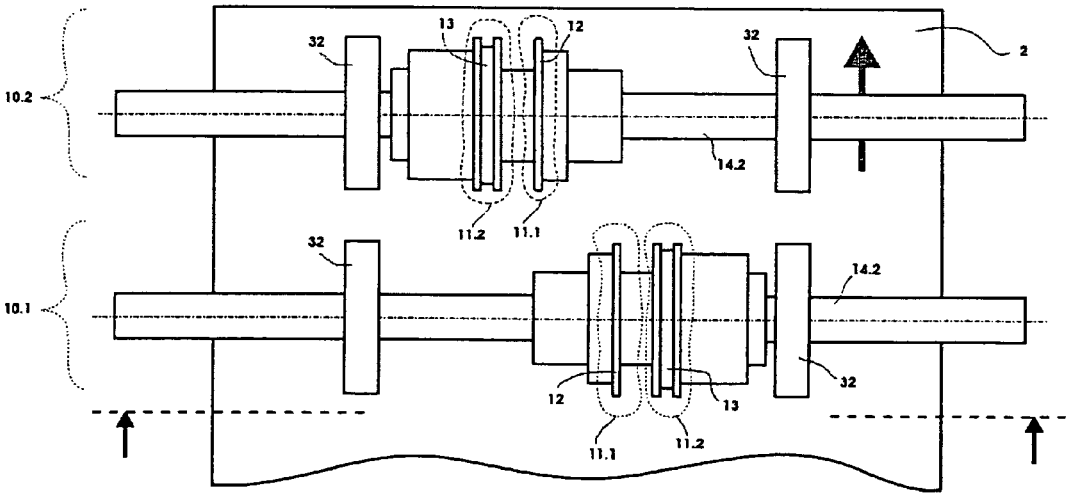
Fig. 4

DEVICE FOR THE ROTATIVE SCORING OF FLAT PRINTED PRODUCTS

BACKGROUND

The present invention pertains to a device for the rotative scoring of flat printed products.

In the scoring of folded sections, brochure covers, dust jackets, or similar printed products (herein, "printed book products"), the paper material, cardboard material or pasteboard material is deformed into a straight bead or the like by means of compression and/or displacement such that a hinge-like bending line is formed in the sheet. In adhesive binders and folding machines, the scoring is frequently carried out in a rotative fashion, wherein one or more scoring knives and assigned scoring matrices are arranged on parallel scoring shafts that are driven in opposite directions. In order to transport and guide the sheets, transport rollers are arranged on the scoring shafts adjacent to the scoring tools and effectively clamp the sheet with respect to its transport [Prospectus Kolbus KM 473: Kolbus Perfect Binding 8000 cycles/h; April 2004; Kolbus GmbH & Co. KG, D-32369 Rahden].

Due to the common arrangement on the scoring shafts, the scoring tools and the assigned transport rollers always have the same axial spacing. This creates an interrelationship that leads to a conflict in the adjustment of the scoring shaft spacing. On one hand, the adjustment of the spacing is used for varying the scoring intensity or scoring depth as the scoring knives penetrate more or less deep into the material. On the other hand, the adjustment of the scoring shaft spacing makes it possible to vary the clamping of the sheets by the transport rollers that are realized elastically on their working surface, wherein the sheet thickness also needs to be taken into consideration. This adjustment of the spacing is carried out in order to ensure a flawless and straight transport without markings by the transport rollers. The transport and the scoring influence one another. With respect to a deep scoring, the transport rollers are adjusted excessively narrow and mark, in particular, sensitive sheet surfaces. Bending and swinging of the scoring shafts may simultaneously occur such that the scoring quality also deteriorates.

In order to process brochure covers with cover flaps that are folded in on one side, both scoring shafts can be adjusted such that they are inclined relative to one another in order to thusly adjust the material thickness between the respective pairs of transport rollers that varies transverse to the scoring direction of the sheet. However, this results in fluctuations between the respective spacing of several pairs of scoring tools that are arranged adjacent to one another on the two scoring shafts such that the grooves produced twofold or fourfold in the spine region of the cover sheet have distinctly different depths.

SUMMARY

The objective of the present invention is to eliminate the aforementioned disadvantages and to develop a device of the initially cited type that makes it possible to realize a high-quality scoring process. The invention should make it possible, in particular, to achieve a uniform scoring quality of several grooves that are simultaneously produced in a sheet adjacent to one another, wherein the grooves should also be straight and arranged parallel to a reference edge in the sheet.

According to the present disclosure, this objective is attained in that the first transport roller is arranged on the first scoring shaft and the second transport roller is supported independently of the scoring tools. The axial spacing of the at least one pair of scoring tools can be adjusted in accordance with the desired scoring depth without affecting the at least one pair of transport rollers. A straight transport that does not create markings is achieved due to the optimal adjustment of the transport rollers with respect to the sheet material and, in particular, its thickness. Due to the axially parallel arrangement of the transport rollers relative to the scoring tools, the sheet is constantly clamped by the transport rollers and thusly guided during the scoring process. The load on the scoring shafts is significantly reduced because bending due to an excessively narrow adjustment of the transport rollers is prevented. If it is intended to process brochure covers with cover flaps that are folded in on one side, a mutually inclined arrangement of the scoring shafts is no longer necessary.

BRIEF DESCRIPTION OF THE DRAWING

The preferred embodiment will be described below with reference to the enclosed drawing, in which:

FIGS. 4 and 5 show the device in top and side views, respectively.

DETAILED DESCRIPTION

Figure 1:
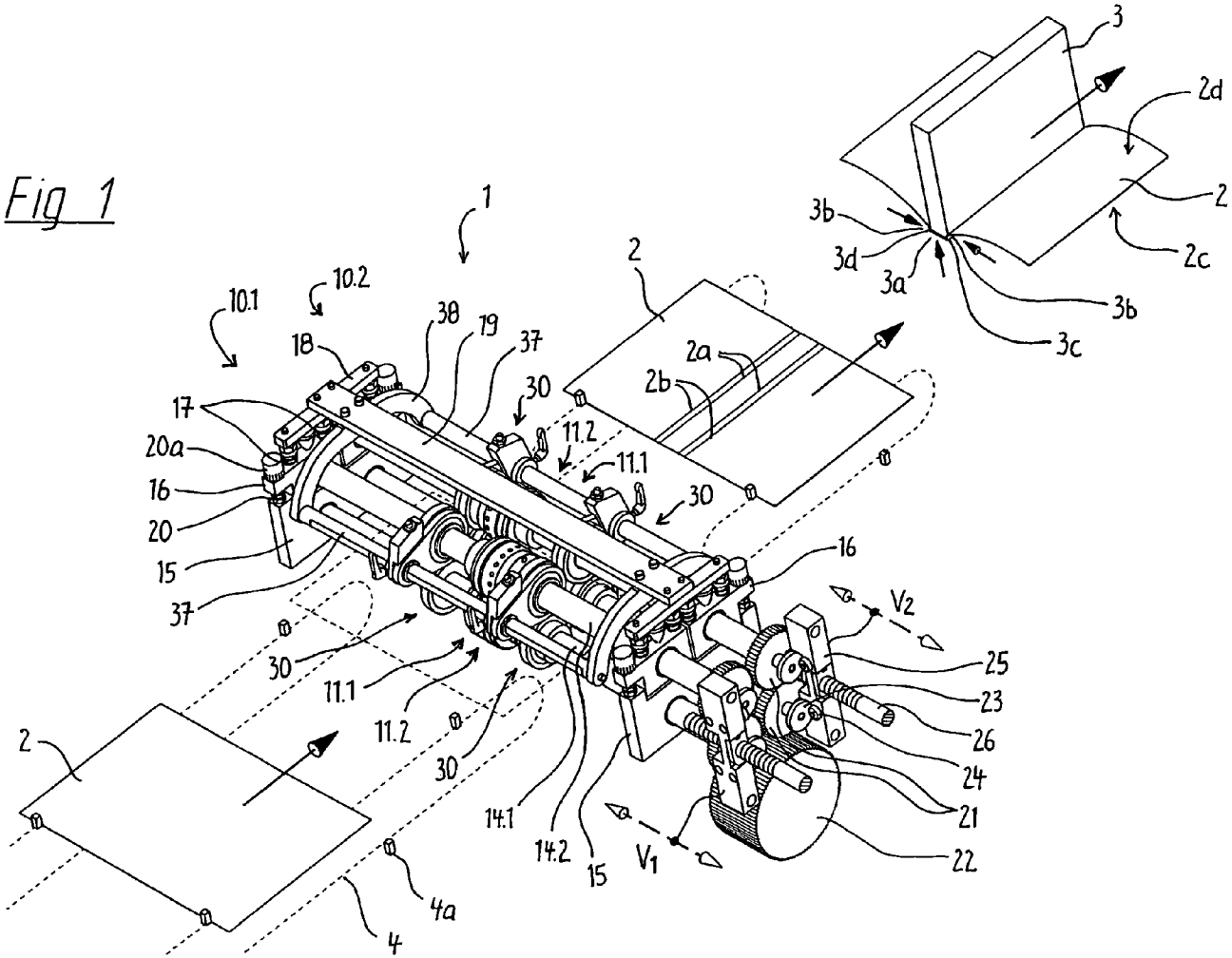
FIG. 1 shows a perspective representation of a scoring device for producing four parallel grooves in the spine region of a cover sheet.
Figure 2:
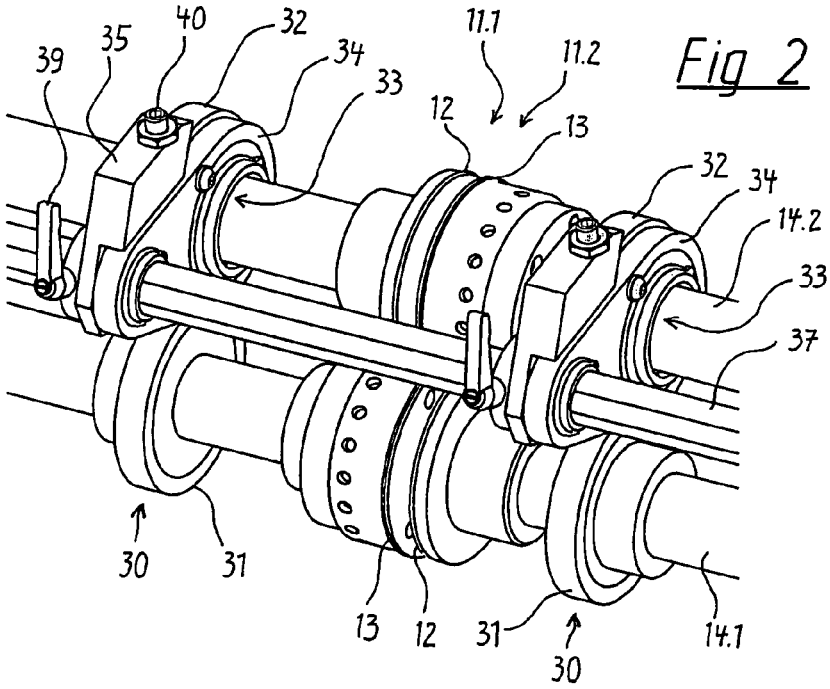
FIG. 2 shows a detailed view of the scoring tools and the transport rollers.
Figure 3:
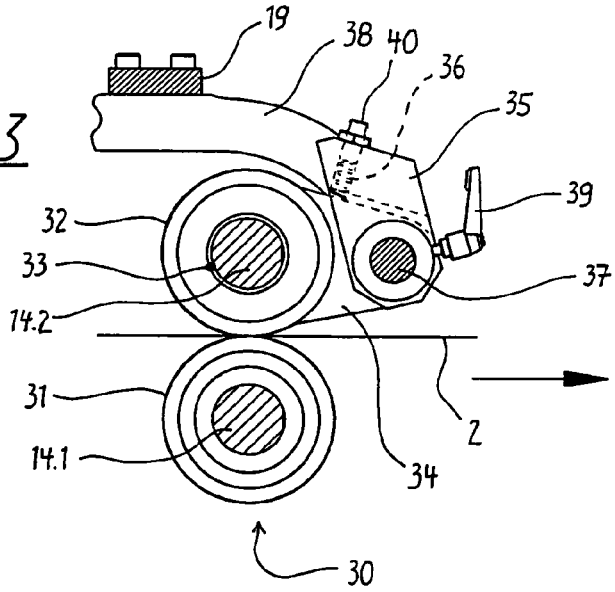
FIG. 3 shows a side view of the transport rollers.

An embodiment of the device is shown in FIGS. 1-5. The scoring device 1 forms part of an otherwise not-shown cover feed system for an adhesive binder, in which a cover sheet 2 is attached to book blocks 3 that were processed on the spine 3*a* and provided with glue. The cover sheet 2 is pressed against the spine 3*a* and the lateral surfaces 3*b* of the book block 3 near the spine. In order to ensure that the cover sheet 2 can be easily bent around the two spine edges 3*c*, 3*d* of the book block 3 and that a hinge is formed in the cover sheet 2 on the end of the respective lateral gluing, four grooves 2*a*, 2*b* are produced in the cover sheet 2 such that they lie parallel and adjacent to one another. Two inner spine grooves 2*a* that border the spine 3*a* are positively scored, i.e., the scoring bead lies on the outer side 2*c*, while the two outer so-called decorative grooves 2*b* are negatively scored such that their scoring beads lie on the inner side 2*d* of the cover sheet 2.

The cover sheets 2 are fed to the scoring device 1 in the form of a continuous transport by pushers 4*a* of a conveyor chain 4. The scoring device 1 comprises two successively arranged scoring units 10.1, 10.2, wherein the first scoring unit 10.1 prepares the spine groove 2*a* and the assigned decorative groove 2*b* for the first spine edge 3*c* and the second scoring unit 10.2 prepares the spine groove 2*a* and the decorative groove 2*b* for the second spine edge 3*d* of the book block 3.

The respective scoring units 10.1 and 10.2 feature two pairs of scoring tools 11.1 and 11.2 that can be adjusted relative to one another and respectively feature a scoring knife 12 and a scoring matrix 13 on parallel scoring shafts 14.1 and 14.2 that are arranged on top of one another and driven in opposite directions. In order to produce the positive spine groove 2*a*, the scoring knife 12 is arranged on the upper scoring shaft 14.2 and the assigned scoring matrix 13 is arranged on the lower scoring shaft 14.1. The knife 12 and the matrix 13 are the scoring tools 12, 13. Together they build a pair 11.1 or 11.2 of scoring tools. A scoring unit 10.1 or 10.2 is built by two pairs of scoring tools 11.1 and 11.2 together with two pairs 30 of transport rollers 31, 32. The tools are arranged in a correspondingly interchanged fashion in order to produce the negative decorative groove 2*b*.

The respective lower scoring shaft 14.1 is rotatably supported on its ends in rigid bearing plates 15 of the frame while the respective upper scoring shaft 14.2 is rotatably supported in bearing plates 16 that are respectively acted upon by biasing springs 17 and can be displaced relative to the frame. A known minimum axial spacing perpendicularly between the two scoring shafts 14.1, 14.2 is ensured with lifting screws 20 that are braced against the rigid bearing plates 15 of the frame. In order to vary the scoring intensity or scoring depth, the lifting screws 20 and therefore the minimum axial spacing can be adjusted in a reproducible fashion with adjusting knobs 20 a that are respectively provided with a scale. The aforementioned springs 17 are braced on rigid holders 18 of the frame 18 that are connected to one another by a bridge 19.

The drive of the oppositely driven scoring shafts 14.1 and 14.2 is realized with gearwheels 21 that are arranged on the ends of the scoring shaft and engaged with one another, wherein the gearwheels 21 of the lower scoring shafts 14.1 engage with a driving gear 22 that is connected to the main drive of the cover feed system.

The positioning of the grooves 2*a*, 2*b* on the cover sheet 2 is realized in the form of an axial displacement of the rotatably supported scoring shafts 14.1, 14.2 that can be axially displaced in the respective bearing plates 15 and 16. To this end, disks 23 are arranged on the ends of the scoring shafts 14.1, 14.2 and guided between cam rollers 24 that are arranged on adjusting plates 25, wherein adjusting spindles 26 engage into the adjusting plates 25. Double arrows drawn with broken lines symbolize an adjustment $V_1$ of the two grooves for the first spine edge 3*c* on the first scoring unit 10.1 and an adjustment $V_2$ of the two grooves for the second spine edge 3*c* on the second scoring unit 10.2.

In order to transport the cover sheets 2 during the scoring process, transport rollers are arranged adjacent to the scoring tools. According to the invention, the respective pairs of transport rollers 30 are formed by a first transport roller 31 that is arranged in a rotationally rigid fashion on the lower scoring shaft 14.1 and a second free rotating transport roller 32 that is supported independently of the scoring tools, as the transport roller 32 is not supported (pivot-mounted) on second scoring shaft 14.2.

The second transport roller 32 is rotatably accommodated on a pivoted lever 34 that is supported on an axle 37 that extends parallel to the scoring shafts 14.1, 14.2 and mounted on support arms 38 that originate at the bridge 19. A defined pressing force of the second transport roller 32 against the first transport roller 31 is achieved in that the pivoted lever 34 is urged or biased in a springable fashion against a supporting lever 35 that is arranged in a rotatable rigid fashion on the axle 37, and in that the force of the pressure spring 36 can be adjusted by means of a setscrew 40. Force peaks due to bending of the scoring shafts, as well as flattening of the transport rollers, no longer occur such that a particularly gentle transport of the cover sheets 2 is ensured.

The independent support of the second transport roller 32 is achieved in that a continuous bore 33 is provided in the bearing location of the pivoted lever 34, as well as in the second transport roller 32 itself, such that the second transport roller 32 essentially can be penetrated coaxially by the upper scoring shaft 14.2. The bore 33 has such dimensions that no collision between the upper scoring shaft 14.2 and the second transport roller 32 and the pivoted lever 34 occurs when processing minimum and maximum cover thicknesses, even at extreme scoring tool adjustments.

Due to the coaxial arrangement, the scoring tools 12, 13 and the transport rollers 31, 32 may be realized with identical nominal outside diameters such that a flawless scoring and simultaneously an excellent guidance of the cover sheet 2 are promoted. In addition, this allows a particularly compact construction that provides an excellent view of the scoring process, as well as unhindered access. Due to the independent support of the second transport roller 32, the scoring shafts 14.1, 14.2 can be realized more rigidly such that the scoring quality is additionally improved. Swinging of the scoring shafts 14.1, 14.2 is prevented, in particular, during the infeed of the cover sheet 2 into the scoring tools 12, 13.

The respective second transport roller 32 is positioned relative to the first transport roller 31 that can be displaced by the lower scoring shaft 14.1 by manually displacing the assigned supporting lever 35 along the axle 37 and axially fixing the second transport roller on the axle 37 by means of clamping levers 39.

The invention claimed is:

1. A device (1) for the rotative scoring of a bending line in printed book products supplied in the form of a flat sheet (2), including at least one pair (11.1 or 11.2) of scoring tools (12, 13) having a scoring knife (12) and an assigned scoring matrix (13), wherein the scoring tools (12, 13) are arranged on a first and a second parallel scoring shaft (14.1, 14.2) driven in opposite directions; and at least one pair (30) of transport rollers (31, 32) that is arranged axially adjacent to the pair of scoring tools (11.1 or 11.2), having a first and a second transport roller (31, 32) and together clamp and transport the sheet (2) during running operation;

wherein the improvement comprises that the first transport roller (31) is fixed on for co-rotation with the first scoring shaft (14.1) and the second transport roller (32) is supported independently of the scoring tools (12, 13), said independent support including an axial bore (33) in the second transport roller that is axially penetrated by the second scoring shaft (14.2) with circumferential clearance around the second scoring shaft during running operation such that the second transport roller freely rotates about the second scoring shaft;

whereby the support for the second roller transport roller adjustably offsets the axis of the second transport roller relative to the axis of the second scoring shaft without contact between the second transport roller and the second scoring shaft during running operation.

2. The device according to claim 1 wherein the second transport roller (32) is rotatably accommodated on a pivoted lever (34) that is arranged offset to the scoring shafts (14.1, 14.2), whereby the pivoted lever provides said adjustable support for the second transport roller.

3. The device according to claim 1, wherein the second transport roller (32) is adjustably biased relative to the first transport roller (31).

4. The device according to claim 3, wherein the second transport roller (32) adjustably biased with a spring relative to the first transport roller (31).

5. A device (1) for the rotative scoring of a bending line in printed book products supplied in the form of a flat sheet (2), comprising:

a fixed frame (15);

successively arranged scoring units (10.1 and 10.2) within the frame, each scoring unit having two pairs (11.1, 11.2) of scoring tools each consisting of a scoring knife (12) and an assigned scoring matrix (13), wherein one tool (knife 12 or matrix 13) of a pair (11.1 or 11.2) of scoring tool is arranged on a first scoring shaft (14.1) and the other tool (13 or 12) of that pair of scoring tool is arranged on a second scoring shaft (14.2), with said second scoring shaft (14.2) arranged parallel to and vertically above the first scoring shaft (14.1) an adjustable distance such that the scoring knife (12) and the scoring matrix (13) of a pair (11.1, 11.2) of scoring tools confront each other;

each scoring unit (10.1 and 10.2) also having two pairs (30) of transport rollers, one pair on either side of the two pairs of scoring tools (11.1, 11.2), wherein each pair (30) of transport rollers has a first roller (31) beneath a second roller (32) such that rotation of the two pairs of transport rollers (30) clamps and conveys said sheet through the respective scoring unit during running operation;

wherein for each pair (30) of transport rollers, the first transport roller (31) is rotationally fixed with respect to, for co-rotation with, the first scoring shaft (14.1) and the second transport roller (32) is supported in spaced relation around and for independent rotation relative to the second scoring shaft (14.2) during running operation, whereby the second transport roller freely rotates in unison with the first transport roller (31) as a sheet is conveyed there between.

6. The device according to claim 5, wherein the second scoring shaft (14.2) passes axially with clearance through a bore in the second transport roller (32).

7. The device according to claim 6, wherein the second transport roller (32) is rotatably accommodated on a pivoted lever (34) that is supported on an axle (37) that extends parallel to the scoring shafts (14.1 and 14.2).

8. The device according to claim 5, wherein the support for the second transport roller adjustably offsets the axis of the second transport roller relative to the axes of the second scoring shaft and first transport roller without contacting the second scoring shaft such that the distance between the axes of the first and second transport rollers is adjustable independently of the adjustable distance between the first and second scoring shafts.

* * * * *